US008420005B2

(12) United States Patent
Chou et al.

(10) Patent No.: US 8,420,005 B2
(45) **Date of Patent: *Apr. 16, 2013**

(54) MELTBLOWN WETLAID METHOD FOR PRODUCING NON-WOVEN FABRICS WITH ANTI-MILDEW, ANTI-BACTERIA AND DEODORIZING CAPABILITIES FROM NATURAL CELLULOSE

(75) Inventors: Wen-Tung Chou, Changhua County (TW); Ming-Yi Lai, Changhua County (TW); Kun-Shan Huang, Tainan (TW)

(73) Assignee: Acelon Chemical and Fiber Corporation, Changhua County (TW)

( * ) Notice: Subject to any disclaimer, the term of this patent is extended or adjusted under 35 U.S.C. 154(b) by 216 days.

This patent is subject to a terminal disclaimer.

(21) Appl. No.: 12/879,042

(22) Filed: Sep. 10, 2010

(65) Prior Publication Data

US 2011/0156299 A1 Jun. 30, 2011

(30) Foreign Application Priority Data

Dec. 31, 2009 (TW) ..... 98146657 A

(51) Int. Cl.

| | |
|---|---|
| ***D01D 5/06*** | (2006.01) |
| ***D01D 10/06*** | (2006.01) |
| ***D01F 2/02*** | (2006.01) |
| ***D04H 3/10*** | (2006.01) |

(52) U.S. Cl.

USPC ..... 264/555; 28/104; 28/107; 264/103; 264/178 F; 264/187; 264/202; 264/203; 264/211.12; 264/211.16

(58) Field of Classification Search ..... 264/103, 264/178 F, 187, 202, 203, 211.12, 211.16, 264/555; 28/104, 107

See application file for complete search history.

(56) References Cited

U.S. PATENT DOCUMENTS

| | | | | |
|---|---|---|---|---|
| 4,107,374 | A * | 8/1978 | Kusunose et al. | 442/400 |
| 6,207,601 | B1 * | 3/2001 | Maurer et al. | 442/333 |
| 6,524,508 | B1 | 2/2003 | Ohnishi et al. | |
| 6,551,705 | B1 | 4/2003 | Ohnishi et al. | |
| 7,153,525 | B1 | 12/2006 | Mumper et al. | |
| 8,092,732 | B2 * | 1/2012 | Chou et al. | 264/211.12 X |
| 2002/0148050 | A1 * | 10/2002 | Luo et al. | 8/115.51 |
| 2005/0230860 | A1 * | 10/2005 | Bhushan et al. | 264/178 F X |
| 2008/0287025 | A1 * | 11/2008 | Ebeling et al. | 442/400 |
| 2009/0165969 | A1 * | 7/2009 | Luo | 162/76 |
| 2010/0167018 | A1 * | 7/2010 | Luo et al. | 428/172 |

* cited by examiner

*Primary Examiner* — Leo B Tentoni

(74) *Attorney, Agent, or Firm* — Bacon & Thomas, PLLC

(57) ABSTRACT

The present invention provides a meltblown wetlaid method for producing non-woven fabrics with anti-mildew, anti-bacteria and deodorizing capabilities from natural cellulose. The method comprises selecting wood pulp as raw material and using N-methylmorpholine N-oxide (NMMO) as dissolving solvent and 1,3-phenylene-bis 2-oxazoline (BOX) as stabilizer to form mixed cellulose mucilage as well as using modified and nano-miniaturized natural chitosan as additive for blending and dissolution to form cellulose dope. By meltblown method, the dope is extruded out of spinnerets to form filament bundle, then by ejecting mist aerosol of water, the filament bundle is coagulated with regeneration. After post treatments of water rinsing, hydro-entangled needle punching, drying, winding-up and the like having been orderly applied, then final product for nonwoven fabric of continuous filament with anti-mildew, anti-bacteria and deodorizing capabilities is produced.

17 Claims, 5 Drawing Sheets

(1→4)-2-amino-2-deoxy-β-D-glucan

β-1,4'-poly--D-glucosamine

MELTBLOWN WETLAID METHOD FOR PRODUCING NON-WOVEN FABRICS WITH ANTI-MILDEW, ANTI-BACTERIA AND DEODORIZING CAPABILITIES FROM NATURAL CELLULOSE

FIELD OF THE PRESENT INVENTION

The present invention relates to a "meltblown wetlaid method for producing non-woven fabrics with anti-mildew, anti-bacteria and deodorizing capabilities from natural cellulose", particularly for one with environment protective process that not only has advantages in low manufacturing cost without environmental pollution but also features good anti-mildew, anti-bacteria and deodorizing capabilities so that it meet medical and industrial application requirements such as apparels, sanitary and medical materials, filtrating materials, wiping materials for biomedical and optoelectronic wafers and the like.

BACKGROUND OF THE INVENTION

Currently, most nonwoven fabrics of chemical synthetic fiber are produced from melted macromolecule polymers and made by spunlaid process through extrusion and stretch to form continuous filaments as well as stacking laying for web formation so that the nonwoven fabrics of such filaments feature in good physical properties of air permeability and water absorption. Thus, such nonwoven fabrics of chemical synthetic fiber are prevalently used in application fields of medical, sanitary, wiper, filters and so on. According to the survey and statistics of Association of the Nonwoven Fabrics Industry USA (INDA), the marketing share for the nonwoven fabrics of chemical synthetic produced spunlaid process already from 33.5% in 1994 (second) leaps up to 43.7% in 2009 (first) with total annual yield of 2.7 million tons. Wherein, main raw materials are from polypropylene (PP), polyester (PET), polyethylene (PE) and Nylon in quantity order with overall consumed quantity 96%. However, the wasted nonwoven fabric of chemical synthetic fiber after having been used incurs a malignant impact to the environment because they are indissoluble by natural environment.

Chitin and Chitosan are linear polymers (namely linear-chained macromolecule polymers) produced from N-acetyl Glucosamine monomer and Glucosamine monomer by β-1,4 bond. Materials containing chitin widely distributes in the natural world such as horny shells of shrimps and crabs in crustaceans, etc. From viewpoint in food processing of waste recycling, Chitin and Chitosan are worthwhile to capitalize on exploitation. Moreover, the yield and output value for crustacean processing of shrimp and crabs is a primary project of aquatic product processing in Taiwan for quite a long time. However, the processing wastes, which abundantly contain protein, astaxanthin, chitin and the like, might become an ecologic and environmental burden if they have not been well treated. On the other hand, if they can be well exploited to process into chitin/chitosan, they may not only solve the waste issue but also create economical value with multiple beneficiary effects such as anti-mildew, bacteriostatic and deodorizing functions owing to their intrinsic biodegradibility and bio-compatibility. For processing horny shells of shrimp and crab in crustacean, 20~30% of chitin therein can be obtained by proper purification while various chitosan with different degree of de-acetylating can be obtained via de-acetylating process under high temperature with hot alkali.

Therefore, how to produce nonwoven fabrics of continual filament with excellent anti-mildew, bacteriostatic and deodorizing functions by short eco-friendly process of low manufacturing cost from natural fiber material becomes an urgent and critical issue. Having realized and addressed above issue, the inventor of the present invention has been enthusiastically performing study and research in painstaking manner for quite a long time. Eventually, a satisfactory nonwoven fabric of continual filament with excellent anti-mildew, bacteriostatic and deodorizing functions is successfully worked out as disclosed in this specification.

SUMMARY OF THE INVENTION

The primary object of the present invention is to provide a "meltblown wetlaid method for producing non-woven fabrics with anti-mildew, anti-bacteria and deodorizing capabilities from natural cellulose". The method is to select wood pulp as raw material and use N-methylmorpholine N-oxide (NMMO) as dissolving solvent and 1,3-phenylene-bis 2-oxazoline (BOX) as stabilizer to form mixed cellulose mucilage as well as use modified and nano-miniaturized natural chitosan as additive for blending and dissolution to form cellulose dope. By meltblown method, the dope is extruded out of spinnerets to form filament bundle; and by ejecting mist aerosol of water, the filament bundle is coagulated with regeneration; After post treatments of water rinsing, hydro-entangled needle punching, drying, winding-up and the like have been orderly applied, then final product for nonwoven fabric of continuous filament with anti-mildew, anti-bacteria and deodorizing capabilities is produced. Accordingly, the present invention becomes an environment protective process with advantages in low manufacturing cost due to short process and solvent adequately recycle without environmental pollution due to nontoxic N-methylmorpholine N-oxide (NMMO). Besides, even after 10 times laundering in 70° C. hot water with 5 g/L detergent for 45 minutes, the nonwoven fabric of natural cellulose produced by the method of the present invention can still keep anti-mildew, anti-bacteria and deodorizing capability as that before laundering.

The other object of the present invention is to provide a "meltblown wetlaid method for producing non-woven fabrics with anti-mildew, anti-bacteria and deodorizing capabilities from natural cellulose" to produce nonwoven fabrics with anti-mildew, anti-bacteria and deodorizing capability from natural cellulose so that it not only has advantages in low manufacturing cost without environmental pollution but also features good degree of air permeability and degree of water absorption. Thereby, it meet medical and industrial application requirements such as apparels, sanitary and medical materials, filtrating materials, wiping materials for biomedical and optoelectronic wafers and the like because its waste is biodegradable without any harmful effect in environment.

DETAILED DESCRIPTION OF THE PREFERRED EMBODIMENTS

Figure 1:
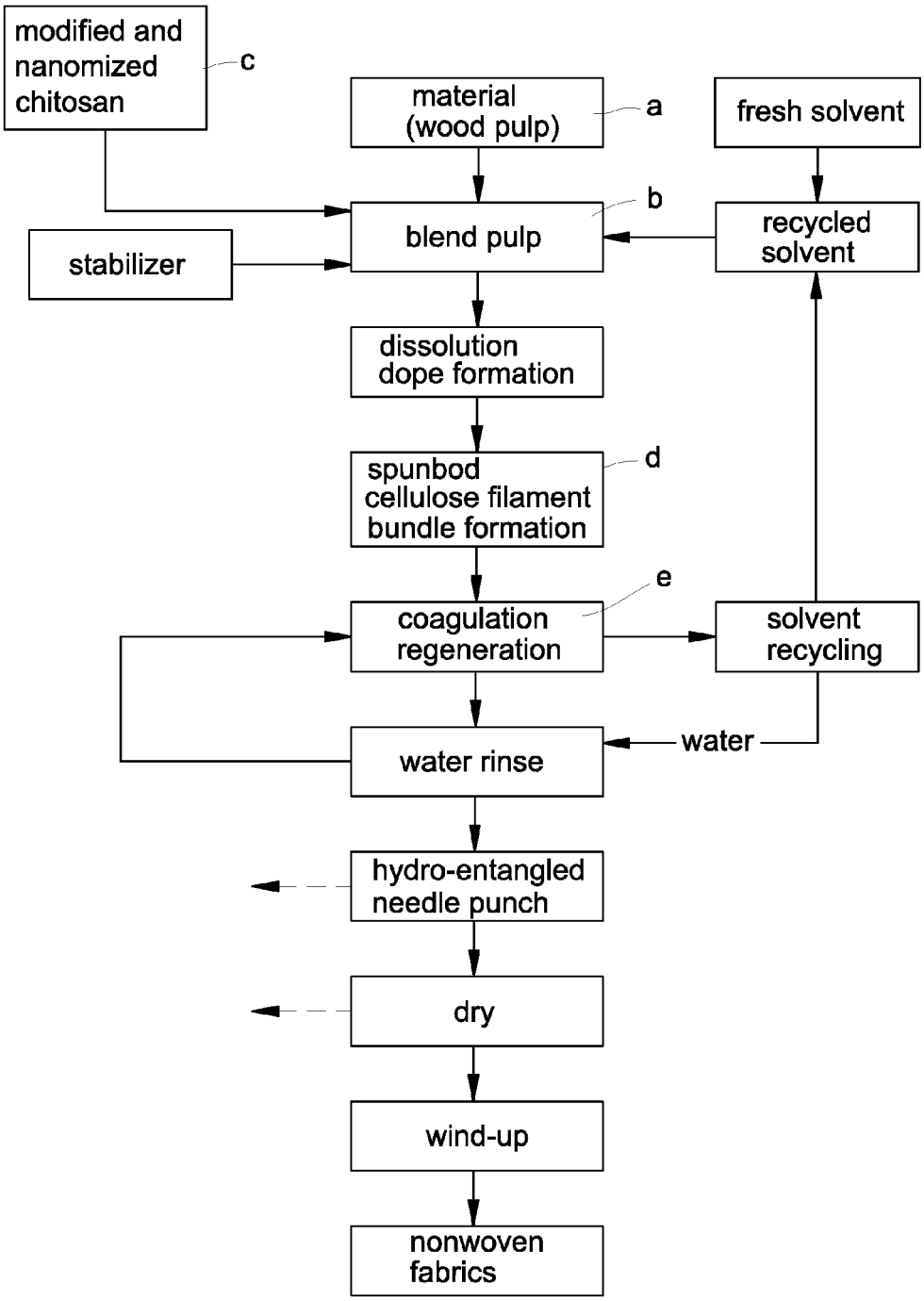
FIG. 1 is a flow chart of block diagram showing the fabricating process of the present invention.
Figure 2:
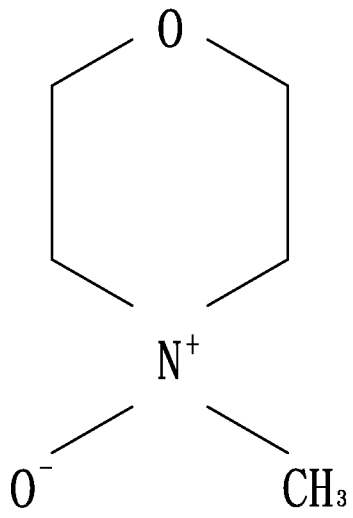
FIG. 2 is a chemical structure of the N-methylmorpholine N-oxide (NMMO) used in the present invention.
Figure 3:
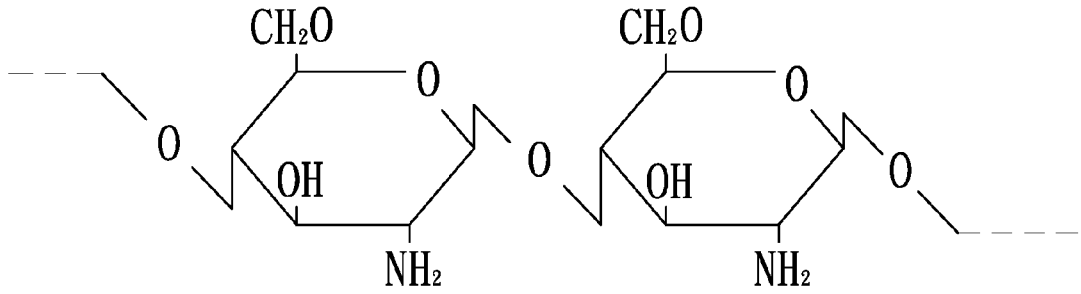
FIG. 3 is a chemical structure of the chitosan used in the present invention.
Figure 4:
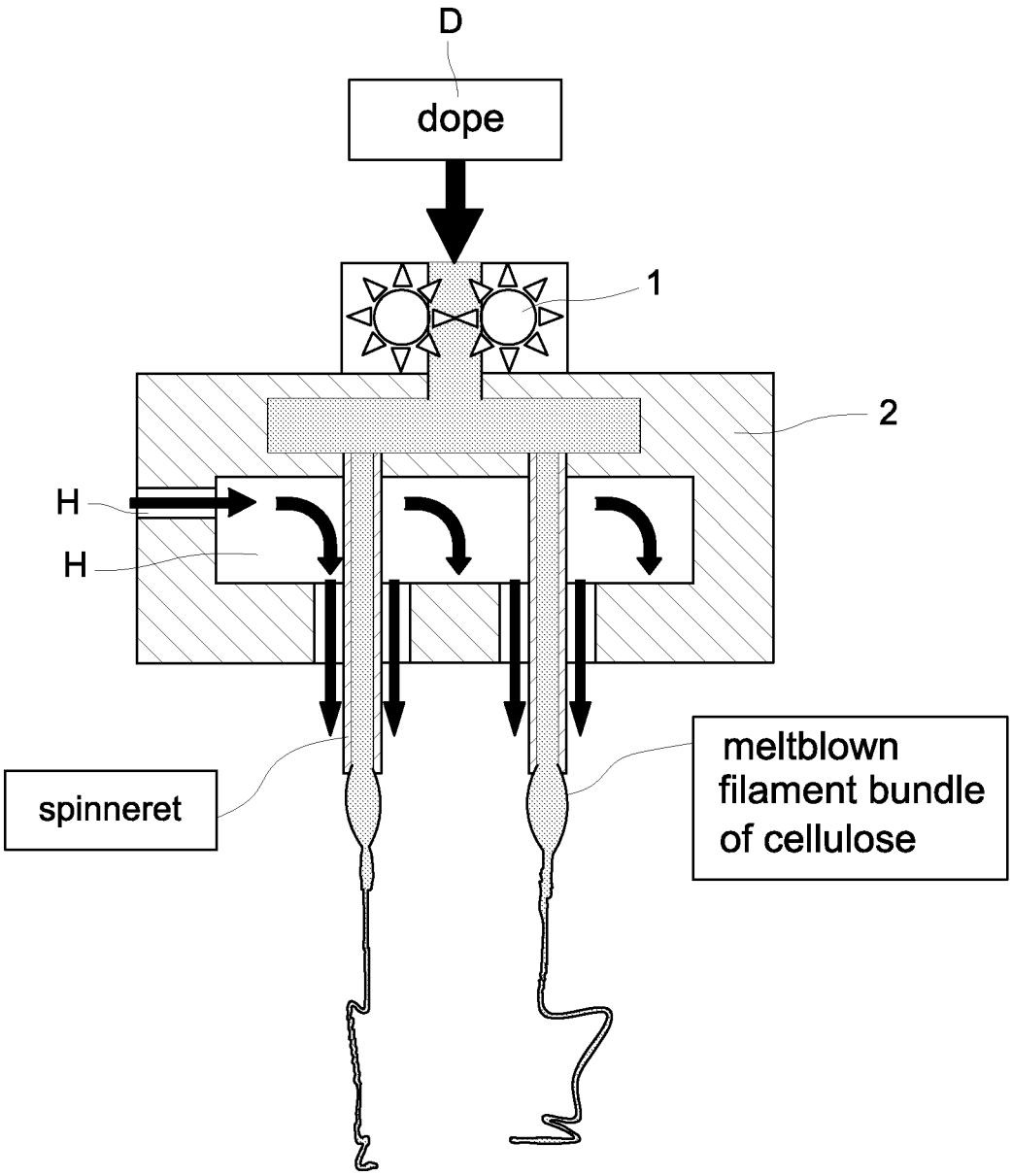
FIG. 4 is an operational schematic view showing a forming process for melt-blown nonwoven of the present invention.
Figure 5:
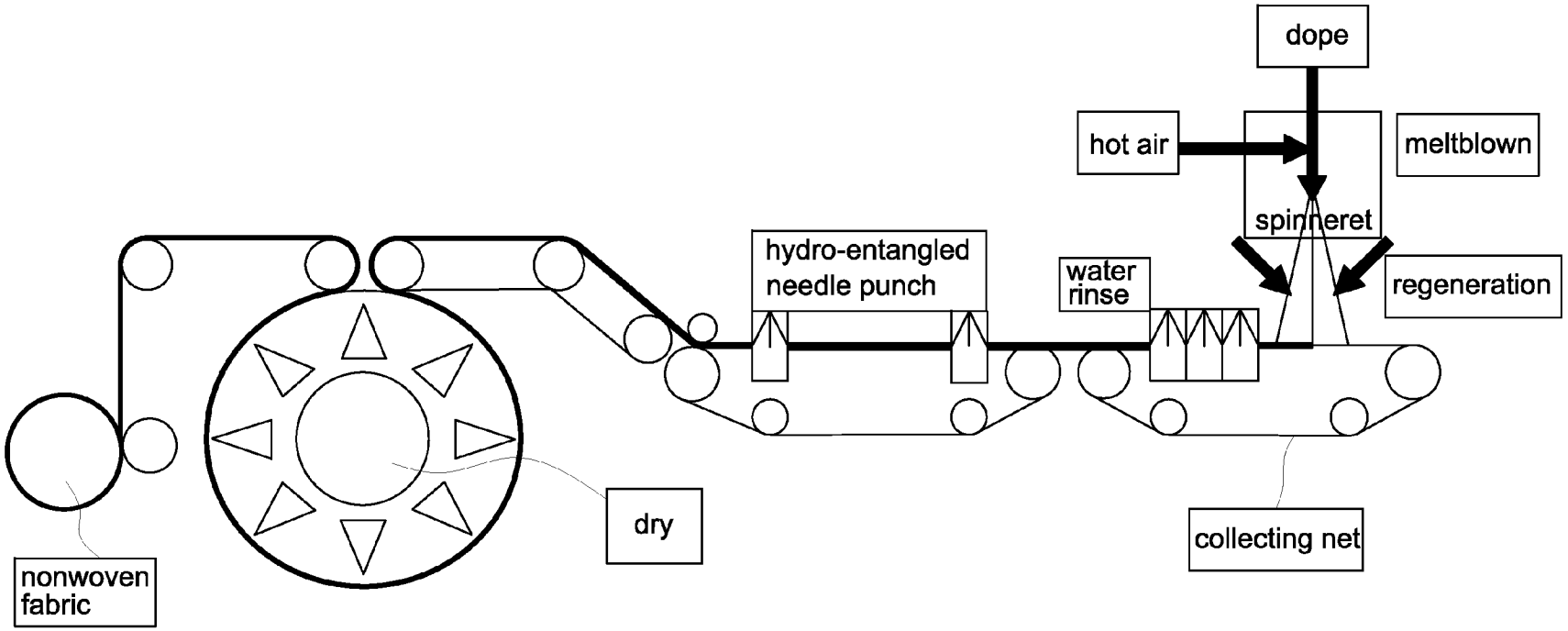
FIG. 5 is a fabrication processing view showing an overall meltblown wetlaid method of the present invention.

For further disclose the fabricating process and efficacy, detailed description for some preferred exemplary embodiments with associated drawings is presented below. Please refer to FIGS. 1 through 5, which showing the "meltblown wetlaid method for producing non-woven fabrics with anti-mildew, anti-bacteria and deodorizing capabilities from natural cellulose" of the present invention, wherein the anti-bacteria capability includes bacteriostatic capability and bactericidal capability. The process of the method comprises following steps.

a. Material Selection and Preparation: Select wood pulp as raw material, preferably pulp cellulose of staple or filament with cellulose content being over 85% and degree of polymerization (DP) being between 500~1200;

b. Solvent adding and Mucilage Formation: Put N-methylmorpholine N-oxide (NMMO) (whose chemical structure as shown in FIG. 2) as dissolving solvent and 1,3-phenylene-bis 2-oxazoline (BOX) as stabilizer into prepared pulp to form mixed cellulose mucilage;

c. Dope Blending and Dissolution: Put and blend modified and nano-miniaturized natural chitosan (whose chemical structure as shown in FIG. 2) into the mixed cellulose mucilage of pulp and N-methylmorpholine N-oxide (NMMO) to form cellulose dope that is accomplished via rapidly grinding, blending and dissolving the cellulose mucilage under low temperature between 60 degree of Celsius and 80 degree of Celsius (60° C.~80° C.) by horizontal dope blending machine; Then, dehydrate it via heating up to temperature between 80 degree of Celsius and 120 degree of Celsius (80° C.~120° C.) by vacuum thin film evaporator for 5 minutes to decrease water content thereof down to 5~13% so that a homogenized mucilaginous dope D can be formed;

d. Meltblown and Filament Formation: By meltblown method, the dope D is extruded out of spinnerets 3 to form filament bundle as shown in FIG. 4, the dope D is fed into a die assembly 2 and forcedly extruded out spinnerets 3 via a gear pump 1 to form filament bundle, wherein certain hot air H is continuously filled in for circulation therein then discharged out via surrounding of the spinnerets 3; and e. Coagulation, Web and Fabric Formation: By means of ejecting mist aerosol of water, the filament bundle is coagulated with regeneration; After post treatments of water rinsing, hydro-entangled needle punching, drying, winding-up and the like have been orderly applied (as shown in FIG. 5), then final product for nonwoven fabrics of continuous filament with anti-mildew, anti-bacteria and deodorizing capabilities are produced from natural cellulose.

Wherein, for the N-methylmorpholine N-oxide (NMMO) in above step b, the concentration thereof is 50%~75% with nontoxic nature so that it can be recycled with low consumption rate via filtration, decolor, and condensation under low pressure distillation after having been drained out in water rinse process with rate of recovery up to over 99.5%. Thereby, it completely complies with the criteria of the environmental protection because it not only can reduce the manufacturing cost but also will not incur any harmful pollution to the environment.

Wherein, for the natural chitosan of macromolecule in above step c, the primary material source thereof is wasted horny shells of shrimp and crab by chemical treatment with following steps: firstly, by acid and alkali treatment to separate chitin out, then purify it; secondly, by hot alkali treatment for excluding N-acetyl group to form chitosan; and finally, by NaOH treatment with suitably controlled concentration, heating temperature and time to perform deacetylation on the chitosan in range of 50%~99% so that final chitosan product with molecular weight in range of 10,000~520,000 is produced.

Moreover, for the dope D in above step c, the content percentage of cellulose thereof is 6 wt %~15 wt %, the viscosity thereof is 300~3000 poise, the light transmittance index thereof is 1.470~1.495, and the melting Index thereof is 400~1000 while the content percentage of chitosan in cellulose fiber is 0.1 wt %~7.0 wt %.

In the above step c, for the acid and alkali treatment, the acid is hydrochloric acid (HCl), sulfuric acid ($H_2SO_4$) and the like of strong acid while the alkali is sodium hydroxide (NaOH), potassium hydroxide (KOH) and the like of strong base.

Besides, in the above step c, the method for the property modification and nano-miniaturization of the natural chitosan generally comprises following steps: firstly, by molecular weight control technique, degrade the chitosan to obtain the interim chitosan of middle and low molecular weight; secondly, by quaternary ammonium salt/synthesis, further modify the interim chitosan of middle and low molecular weight to perform preliminary property modification; and finally, by sol-gel method, directly modify chitosan to finish the property modification and nano-miniaturization so that final chitosan product features in excellent bio-compatibility and bio-activity.

Furthermore, in the above step e, the winding-up speed is 2~200 meters per minute.

For further proving the features and efficacy of the present invention, some exemplary experimental cases having been performed with measured data are described as following.

First Exemplary Embodiment

For Samples 1 Through 12 a. Select pulp with degree of polymerization for the cellulose thereof being 650 as raw material;

b. Select chitosan with range in degree of deacetylation for chitin being 87%~95% such that range in mixing percentage thereof being 0.1 wt %~5.0 wt % after property modification and nano-miniaturization; then, add the chitosan with solvent N-methylmorpholine N-oxide (NMMO) of suitable content percentage into prepared pulp to form mixed cellulose mucilage;

c. Dehydrate the dope via heating up to temperature between 80 degree of Celsius and 120 degree of Celsius (80° C.~120° C.) by vacuum thin film evaporator for 5 minutes to decrease water content thereof down to 5~13% so that a homogenized mucilaginous dope is formed with composition of dope shown as in TABLE 1;

d. By meltblown method, the dope is fed into a meltblown machine via a measuring pump then extruded out of spinnerets to form filament bundle then web of nonwoven; and e. By coagulation with regeneration of ejecting mist aerosol of water as well as applying post treatments of water rinsing, hydro-entangled needle punching, drying, winding-up and the like, then final products with composition of dope for samples 1 through 12 shown as in TABLE 1 are produced.

TABLE 1

Composition of Dope for Samples 1 through 12

| S U | DP nil | MP of CTS wt % | DDA of CTN % | CP of CL % | CP of SV % | CP of WT % | VC of DP poise | LTI of DP nil | MI of DP nil |
|---|---|---|---|---|---|---|---|---|---|
| 1 | 650 | 0.1 | 87 | 7.6 | 81.3 | 11.1 | 840 | 1.489 | 870 |
| 2 | 650 | 0.5 | 87 | 7.5 | 81.9 | 10.6 | 980 | 1.482 | 820 |
| 3 | 650 | 1.0 | 87 | 8.1 | 81.2 | 10.7 | 1240 | 1.486 | 810 |
| 4 | 650 | 3.0 | 87 | 7.5 | 82.0 | 10.5 | 860 | 1.481 | 850 |
| 5 | 650 | 5.0 | 87 | 7.2 | 81.8 | 11.0 | 960 | 1.485 | 830 |
| 6 | 650 | 7.0 | 87 | 7.9 | 80.9 | 11.2 | 1160 | 1.486 | 740 |
| 7 | 650 | 0.1 | 95 | 7.5 | 81.6 | 10.9 | 980 | 1.482 | 820 |
| 8 | 650 | 0.5 | 95 | 8.1 | 81.5 | 10.4 | 1240 | 1.486 | 810 |
| 9 | 650 | 1.0 | 95 | 7.5 | 81.7 | 10.8 | 860 | 1.481 | 850 |
| 10 | 650 | 3.0 | 95 | 7.2 | 82.3 | 10.5 | 730 | 1.489 | 870 |
| 11 | 650 | 5.0 | 95 | 7.8 | 82.0 | 10.2 | 1080 | 1.488 | 820 |
| 12 | 650 | 7.0 | 95 | 8.1 | 81.8 | 10.1 | 1240 | 1.486 | 810 |

Remark
S = sample
U = unit
DP = degree of polymerization
MP of CTS = mixing percentage of Chitosan
DDA of CTN = degree of de-acetylation for chitin
CP of CL = content percentage of cellulose
CP of SV = content percentage of solvent
CP of WT = content percentage of water
VC of DP = viscosity of dope
LTI of DP = light transmittance index of dope
CP of DP = melting Index of dope

Second Exemplary Embodiment

For Samples 13 Through 24 a. Select pulp with degree of polymerization for the cellulose thereof being 1050 as raw material;

b. Select chitosan with range in degree of deacetylation for chitin being 87%~95% such that range in mixing percentage thereof being 0.1 wt %~5.0 wt % after property modification and nano-miniaturization; then, add the chitosan with solvent N-methylmorpholine N-oxide (NMMO) of suitable content percentage into prepared pulp to form mixed cellulose mucilage;

c. Dehydrate the dope via heating up to temperature between 80 degree of Celsius and 120 degree of Celsius (80° C.~120° C.) by vacuum thin film evaporator for 5 minutes to decrease water content thereof down to 5~13% so that a homogenized mucilaginous dope is formed with composition of dope shown as in TABLE 1;

d. By meltblown method, the dope is fed into a meltblown machine via a measuring pump then extruded out of spinnerets to form filament bundle then web of nonwoven; and e. By coagulation with regeneration of ejecting mist aerosol of water as well as applying post treatments of water rinsing, hydro-entangled needle punching, drying, winding-up and the like, then final products with composition of dope for samples 13 through 24 shown as in TABLE 2 are produced.

TABLE 2

Composition of Dope for Samples 13 through 24

| S U | DP nil | MP of CTS wt % | DDA of CTN % | CP of CL % | CP of SV % | CP of WT % | VC of DP poise | LTI of DP nil | MI of DP nil |
|---|---|---|---|---|---|---|---|---|---|
| 13 | 1050 | 0.1 | 87 | 7.8 | 81.8 | 10.4 | 1080 | 1.488 | 720 |
| 14 | 1050 | 0.5 | 87 | 7.5 | 81.1 | 11.4 | 980 | 1.482 | 720 |
| 15 | 1050 | 1.0 | 87 | 7.1 | 82.1 | 10.8 | 830 | 1.489 | 790 |
| 16 | 1050 | 3.0 | 87 | 7.2 | 82.0 | 10.8 | 930 | 1.489 | 770 |
| 17 | 1050 | 5.0 | 87 | 7.9 | 81.0 | 11.1 | 1240 | 1.481 | 650 |
| 18 | 1050 | 7.0 | 87 | 7.2 | 82.2 | 10.6 | 1560 | 1.480 | 620 |
| 19 | 1050 | 0.1 | 95 | 7.9 | 80.2 | 11.9 | 1420 | 1.482 | 600 |
| 20 | 1050 | 0.5 | 95 | 8.0 | 81.5 | 10.5 | 1450 | 1.476 | 640 |
| 21 | 1050 | 1.0 | 95 | 8.1 | 82.1 | 10.8 | 1510 | 1.479 | 680 |
| 22 | 1050 | 3.0 | 95 | 7.9 | 80.2 | 11.9 | 1560 | 1.480 | 620 |
| 23 | 1050 | 5.0 | 95 | 7.5 | 82.0 | 10.5 | 1120 | 1.482 | 640 |
| 24 | 1050 | 7.0 | 95 | 7.2 | 82.1 | 10.7 | 1080 | 1.476 | 660 |

Remark
S = sample
U = unit
DP = degree of polymerization
MP of CTS = mixing percentage of Chitosan
DDA of CTN = degree of de-acetylation for chitin
CP of CL = content percentage of cellulose
CP of SV = content percentage of solvent
CP of WT = content percentage of water
VC of DP = viscosity of dope
LTI of DP = light transmittance index of dope
CP of DP = melting Index of dope

Third Exemplary Embodiment

Assessment for Anti-Mildew Capability

Testing fungus (or microorganism specimen):

Adopt *Staphylococcus aureus* subsp. Aureus10451 as experiment fungus.

Reagent:

Take 0.2 ml of testing fungus solution, which incubate said fungus up to 5~70E+5 (number/ml), to mix with sterilized buffer saline for violently shaking 30 times so that the testing fungi spread over the solution, which is properly diluted into reagent.

Experiment:

Take 1 ml of foregoing reagent for agar broth incubation under temperature condition of 35 degree of Celsius (35° C.) for 48 hours.

Calculation:

Count the growth number of the incubated fungi aforesaid to figure out the actual fungus number on the sample by calculation of the dilution multitude and volume.

Assay:

Repeat above experiment for 6 times and average the total fungus number for each experiment. The resulting Increment or decrement, which is calculated by following formula, can be used for evaluating the antifungal effect of each sample:

$$\text{Increment or decrement} = \log\left(\frac{B}{A}\right) - \log\left(\frac{C}{A}\right)$$

Where,

A denotes fungus number of sample without adding chitosan, the sample is immediately incubated in the saline upon the reagent applying thereon.

B denotes fungus number of sample without adding chitosan, the sample is incubated in the saline after 18 hours later the reagent applying thereon.

C denotes fungus number of sample with chitosan adding, the sample is incubated in the saline after 18 hours later the reagent applying thereon.

Evaluating criterion:

According to the experiment results, the sample has anti-fungal effect if the increment exceeds 1.6. The assay results for each sample (namely samples 1 through 24) are shown in the TABLE 3 below.

TABLE 3

Anti-mildew Capability of Cellulose Nonwoven Containing Chitosan

| S U | DP nil | MP of CTS wt % | DDA of CTN % | Increment/ Decrement +/− | Assess Result Yes/No |
|---|---|---|---|---|---|
| 1 | 650 | 0.1 | 87 | 1.25 | No |
| 2 | 650 | 0.5 | 87 | 1.72 | yes |
| 3 | 650 | 1.0 | 87 | 2.28 | yes |
| 4 | 650 | 3.0 | 87 | 2.53 | yes |
| 5 | 650 | 5.0 | 87 | 2.75 | yes |
| 6 | 650 | 7.0 | 87 | 2.86 | yes |
| 7 | 650 | 0.1 | 95 | 1.48 | No |
| 8 | 650 | 0.5 | 95 | 1.87 | yes |
| 9 | 650 | 1.0 | 95 | 2.33 | yes |
| 10 | 650 | 3.0 | 95 | 2.54 | yes |
| 11 | 650 | 5.0 | 95 | 2.80 | yes |
| 12 | 650 | 7.0 | 95 | 2.97 | yes |
| 13 | 1050 | 0.1 | 87 | 1.25 | No |
| 14 | 1050 | 0.5 | 87 | 1.80 | yes |
| 15 | 1050 | 1.0 | 87 | 2.30 | yes |
| 16 | 1050 | 3.0 | 87 | 2.51 | yes |
| 17 | 1050 | 5.0 | 87 | 2.68 | yes |
| 18 | 1050 | 7.0 | 87 | 2.83 | yes |
| 19 | 1050 | 0.1 | 95 | 1.25 | No |
| 20 | 1050 | 0.5 | 95 | 1.89 | yes |
| 21 | 1050 | 1.0 | 95 | 2.35 | yes |
| 22 | 1050 | 3.0 | 95 | 2.54 | yes |
| 23 | 1050 | 5.0 | 95 | 2.71 | yes |
| 24 | 1050 | 7.0 | 95 | 2.89 | yes |

Remark
S = sample
U = unit
DP = degree of polymerization
MP of CTS = mixing percentage of Chitosan
DDA of CTN = degree of de-acetylation for chitin

Fourth Exemplary Embodiment

Assessment for Anti-Bacteria Capability

Testing bacteria:

Adopt type (A) bacteria: Methicillin Resistant *Staphyloccous Aureus* (MRSA) (ATCC 6538P) and type (B) bacteria: *Klebsiella pheumoniae* (ATCC 4352) as two experiment bacteria.

Principle:

The ordinary chitosan is the derivative of the chitin through deacetylation. The chitosan is a natural non-toxic high polymer with bacteriostatic and biodegradable feature to defend against the fungi and microbes because it is positively charged to readily bind with negatively charged surfaces such as protein. The suppressing ability to the bacteria and fungi of the chitosan comes from its molecular weight and functional radical, which will bond with aluminate acid or silicic acid on the phospholipid substance, so that the activity of the microbe is curbed. The oligmer of chitosan can penetrate the biological cell membrane to repress the duplicating of the RNA.

Testing object:

Take modified chitosan of the present invention as anti-bacteria sample to test whether it has anti-bacteria function of bacteriostatic capability and bactericidal capability.

TABLES 4 and 5 list testing results in anti-bacteria capability of cellulose nonwoven, wherein chitosan is contained therein while the anti-bacteria capability includes bacteriostatic capability and bactericidal capability.

Foundation:

The experiment is in accordance with JIS L1902-1998 Quantitative Method.

Testing bacteria:

Adopt type (A) bacteria: Methicillin Resistant *Staphyloccous Aureus* (MRSA) (ATCC 6538P) and type (B) bacteria: *Klebsiella Pheumoniae* (ATCC 4352) as two experiment bacteria.

Experiment:

The incubated bacteria concentration within 1.0±0.3 E+5 (number/ml) means valid for the experiment.

Ma denotes bacteria number of un-processed sample in immediate count upon cleansing without incubation.

Mb denotes bacteria number of un-processed sample after being incubated for 18~24 hours.

Mc denotes bacteria number of processed sample after being incubated for 18~24 hours.

Calculating formula:

The growing activity value of the bacteria (BGA) is calculated by following formula such that BGA>1.5 means valid of the experiment.

| | |
|---|---|
| Growing Activity value of the Bacteria: | BGA = log (Mb) − log (Ma) |
| Bacteriostatic value of the sample: | BSN = log (Mb) − log (Mc) |
| Bactericidal value of the sample: | BKN = log (Ma) − log (Mc) |

Evaluating criterion:

According to criterion from the Japan Association of Fiber Evaluating Technology for new function (JAFET), the anti-bacteria function is that:

The testing sample has bacteriostatic effect if its bacteriostatic value BSN>2.2.

The testing sample has bactericidal effect if its bactericidal value BKN>0.

And, the numerical (1.3 E+4) denotes 13,000 with analog below.

Each testing result in anti-bacteria capability for each respective sample of cellulose nonwoven is listed in TABLES 4 and 5, wherein chitosan is contained therein while the anti-bacteria capability includes bacteriostatic capability and bactericidal capability.

TABLE 4

Anti-bacteria Capability of Cellulose Nonwoven Containing Chitosan

| S U | DP nil | MP of CTS wt % | DDA of CTN % | Bacteriostasis Value nil | Bactericidal Value nil | Testing Result Yes/No |
|---|---|---|---|---|---|---|
| 1 | 650 | 0.1 | 87 | >1.8 | >1.4 | No |
| 2 | 650 | 0.5 | 87 | >5.0 | >3.2 | yes |
| 3 | 650 | 1.0 | 87 | >5.0 | >3.2 | yes |
| 4 | 650 | 3.0 | 87 | >5.0 | >3.2 | yes |
| 5 | 650 | 5.0 | 87 | >5.0 | >3.2 | yes |
| 6 | 650 | 7.0 | 87 | >5.0 | >3.2 | yes |
| 7 | 650 | 0.1 | 95 | >1.9 | >1.3 | No |
| 8 | 650 | 0.5 | 95 | >5.0 | >3.2 | yes |
| 9 | 650 | 1.0 | 95 | >5.0 | >3.2 | yes |
| 10 | 650 | 3.0 | 95 | >5.0 | >3.2 | yes |
| 11 | 650 | 5.0 | 95 | >5.0 | >3.2 | yes |
| 12 | 650 | 7.0 | 95 | >5.0 | >3.2 | yes |
| 13 | 1050 | 0.1 | 87 | >1.8 | >1.4 | No |

TABLE 4-continued

Anti-bacteria Capability of Cellulose Nonwoven Containing Chitosan

| S U | DP nil | MP of CTS wt % | DDA of CTN % | Bacteriostasis Value nil | Bactericidal Value nil | Testing Result Yes/No |
|---|---|---|---|---|---|---|
| 14 | 1050 | 0.5 | 87 | >5.0 | >3.2 | yes |
| 15 | 1050 | 1.0 | 87 | >5.0 | >3.2 | yes |
| 16 | 1050 | 3.0 | 87 | >5.0 | >3.2 | yes |
| 17 | 1050 | 5.0 | 87 | >5.0 | >3.2 | yes |
| 18 | 1050 | 7.0 | 87 | >5.0 | >3.2 | yes |
| 19 | 1050 | 0.1 | 95 | >1.9 | >1.2 | No |
| 20 | 1050 | 0.5 | 95 | >5.0 | >3.2 | yes |
| 21 | 1050 | 1.0 | 95 | >5.0 | >3.2 | yes |
| 22 | 1050 | 3.0 | 95 | >5.0 | >3.2 | yes |
| 23 | 1050 | 5.0 | 95 | >5.0 | >3.2 | yes |
| 24 | 1050 | 7.0 | 95 | >5.0 | >3.2 | yes |

Remark
S = sample
U = unit
DP = degree of polymerization
MP of CTS = mixing percentage of Chitosan
DDA of CTN = degree of de-acetylation for chitin
The experiment complies with JIS L1902-1998 Quantitative Method having Type (A) bacteria of Methicillin Resistant *Staphyloccous Aureus* (MRSA) (ATCC 6538P) as testing bacteria.

TABLE 5

Anti-bacteria Capability of Cellulose Nonwoven Containing Chitosan

| S U | DP nil | MP of CTS wt % | DDA of CTN % | Bacteriostasis Value nil | Bactericidal Value nil | Testing Result Yes/No |
|---|---|---|---|---|---|---|
| 1 | 650 | 0.1 | 87 | >2.1 | >1.2 | No |
| 2 | 650 | 0.5 | 87 | >6.3 | >3.2 | yes |
| 3 | 650 | 1.0 | 87 | >6.3 | >3.2 | yes |
| 4 | 650 | 3.0 | 87 | >6.3 | >3.2 | yes |
| 5 | 650 | 5.0 | 87 | >6.3 | >3.2 | yes |
| 6 | 650 | 7.0 | 87 | >6.3 | >3.2 | yes |
| 7 | 650 | 0.1 | 95 | >2.1 | >1.2 | No |
| 8 | 650 | 0.5 | 95 | >6.3 | >3.2 | yes |
| 9 | 650 | 1.0 | 95 | >6.3 | >3.2 | yes |
| 10 | 650 | 3.0 | 95 | >6.3 | >3.2 | yes |
| 11 | 650 | 5.0 | 95 | >6.3 | >3.2 | yes |
| 12 | 650 | 7.0 | 95 | >6.3 | >3.2 | yes |
| 13 | 1050 | 0.1 | 87 | >2.1 | >1.1 | No |
| 14 | 1050 | 0.5 | 87 | >6.3 | >3.2 | yes |
| 15 | 1050 | 1.0 | 87 | >6.3 | >3.2 | yes |
| 16 | 1050 | 3.0 | 87 | >6.3 | >3.2 | yes |
| 17 | 1050 | 5.0 | 87 | >6.3 | >3.2 | yes |
| 18 | 1050 | 7.0 | 87 | >6.3 | >3.2 | yes |
| 19 | 1050 | 0.1 | 95 | >2.1 | >1.2 | No |
| 20 | 1050 | 0.5 | 95 | >6.3 | >3.2 | yes |
| 21 | 1050 | 1.0 | 95 | >6.3 | >3.2 | yes |
| 22 | 1050 | 3.0 | 95 | >6.3 | >3.2 | yes |
| 23 | 1050 | 5.0 | 95 | >6.3 | >3.2 | yes |
| 24 | 1050 | 7.0 | 95 | >6.3 | >3.2 | yes |

Remark
S = sample
U = unit
DP = degree of polymerization
MP of CTS = mixing percentage of Chitosan
DDA of CTN = degree of de-acetylation for chitin
The experiment complies with JIS L1902-1998 Quantitative Method having Type (B) bacteria of *Klebsiella Pheumoniae* (ATCC 4352) as testing bacteria.

Evaluating inference:

From TABLES 4 and 5, the sample cellulose nonwoven containing the modified chitosan of the present invention has excellent anti-bacteria capability both in bacteriostatic and bactericidal effects for both of bacteria of Methicillin Resistant *Staphyloccous Aureus* (MRSA) (ATCC 6538P) and *Klebsiella Pheumoniae* (ATCC 4352).

Fifth Exemplary Embodiment

Assessment for Deodorizing Capability

The experiment for assaying deodorizing effect is on the testing basis in absorption of the ammonia odor.

Testing method is that first fill the ammonia gas of specific concentration into the air-tight bottle; next put the nonwoven with modified chitosan of specific quantity into the same bottle aforesaid for 15 minutes absorption; then measure the gas concentration in the nonwoven with chitosan before and after putting into the bottle by gas chromatograph (GC).

The ratio of the deodorizing property for ammonia absorption rate (Aa) is calculated by following formula.

| | |
|---|---|
| Deodorization (Test of Ammonia Absorption Rate) | $Aa = (C_I - C_A)/C_I$ |

Where, $C_I$ is the initial gas concentration in the sample chitosan before absorbing ammonia.

$C_A$ is the absorbed gas concentration in the sample chitosan after absorbing ammonia for 15 minutes.

Each testing result in deodorizing capability for each respective sample of cellulose nonwoven is listed in TABLE 6.

TABLE 6

Deodorizing Capability of Cellulose Nonwoven Containing Chitosan

| S U | DP nil | MP of CTS wt % | DDA of CTN % | RP of AA % | Testing Result Yes/No |
|---|---|---|---|---|---|
| 1 | 650 | 0.1 | 87 | 19.5 | No |
| 2 | 650 | 0.5 | 87 | 66.4 | yes |
| 3 | 650 | 1.0 | 87 | 70.3 | yes |
| 4 | 650 | 3.0 | 87 | 80.5 | yes |
| 5 | 650 | 5.0 | 87 | 85.8 | yes |
| 6 | 650 | 7.0 | 87 | 86.9 | yes |
| 7 | 650 | 0.1 | 95 | 23.8 | No |
| 8 | 650 | 0.5 | 95 | 67.2 | yes |
| 9 | 650 | 1.0 | 95 | 71.7 | yes |
| 10 | 650 | 3.0 | 95 | 83.1 | yes |
| 11 | 650 | 5.0 | 95 | 86.9 | yes |
| 12 | 650 | 7.0 | 95 | 88.3 | yes |
| 13 | 1050 | 0.1 | 87 | 20.7 | No |
| 14 | 1050 | 0.5 | 87 | 66.6 | yes |
| 15 | 1050 | 1.0 | 87 | 70.3 | yes |
| 16 | 1050 | 3.0 | 87 | 81.0 | yes |
| 17 | 1050 | 5.0 | 87 | 84.1 | yes |
| 18 | 1050 | 7.0 | 87 | 86.2 | yes |
| 19 | 1050 | 0.1 | 95 | 23.8 | No |
| 20 | 1050 | 0.5 | 95 | 65.8 | yes |
| 21 | 1050 | 1.0 | 95 | 72.5 | yes |
| 22 | 1050 | 3.0 | 95 | 83.1 | yes |
| 23 | 1050 | 5.0 | 95 | 86.9 | yes |
| 24 | 1050 | 7.0 | 95 | 88.3 | yes |

Remark
S = sample
U = unit
DP = degree of polymerization
MP of CTS = mixing percentage of Chitosan
DDA of CTN = degree of de-acetylation for chitin
RP of AA = Rate of ammonia absorption

Sixth Exemplary Embodiment

Assessment for Anti-Mildew, Anti-Bacteria and Deodorizing Capabilities

Testing method is to launder each sample under condition in 70° C. hot water with 5 g/L laundry detergent for 45 minutes. The experimental result for testing the anti-mildew, anti-bacteria and deodorizing capabilities for each sample by foregoing laundering method for 10 times is shown in the TABLES 7, 8 and 9 below.

TABLE 7

Anti-mildew Capability of Cellulose Nonwoven Containing Chitosan After 10 times of laundering in 70° C. hot water with 5 g/L detergent for 45 minutes

| S U | DP nil | MP of CTS wt % | DDA of CTN % | RP of AA % | Testing Result Yes/No |
|---|---|---|---|---|---|
| 1 | 650 | 0.1 | 87 | 1.26 | No |
| 2 | 650 | 0.5 | 87 | 1.68 | yes |
| 3 | 650 | 1.0 | 87 | 2.09 | yes |
| 4 | 650 | 3.0 | 87 | 2.31 | yes |
| 5 | 650 | 5.0 | 87 | 2.55 | yes |
| 6 | 650 | 7.0 | 87 | 2.49 | yes |
| 7 | 650 | 0.1 | 95 | 1.45 | No |
| 8 | 650 | 0.5 | 95 | 1.71 | yes |
| 9 | 650 | 1.0 | 95 | 2.14 | yes |
| 10 | 650 | 3.0 | 95 | 2.32 | yes |
| 11 | 650 | 5.0 | 95 | 2.58 | yes |
| 12 | 650 | 7.0 | 95 | 2.72 | yes |
| 13 | 1050 | 0.1 | 87 | 1.26 | No |
| 14 | 1050 | 0.5 | 87 | 1.66 | yes |
| 15 | 1050 | 1.0 | 87 | 2.07 | yes |
| 16 | 1050 | 3.0 | 87 | 2.11 | yes |
| 17 | 1050 | 5.0 | 87 | 2.42 | yes |
| 18 | 1050 | 7.0 | 87 | 2.58 | yes |
| 19 | 1050 | 0.1 | 95 | 1.27 | No |
| 20 | 1050 | 0.5 | 95 | 1.72 | yes |
| 21 | 1050 | 1.0 | 95 | 2.16 | yes |
| 22 | 1050 | 3.0 | 95 | 2.34 | yes |
| 23 | 1050 | 5.0 | 95 | 2.48 | yes |
| 24 | 1050 | 7.0 | 95 | 2.56 | yes |

Remark
S = sample
U = unit
DP = degree of polymerization
MP of CTS = mixing percentage of Chitosan
DDA of CTN = degree of de-acetylation for chitin
RP of AA = Rate of ammonia absorption

TABLE 8

Anti-bacteria Capability of Cellulose Nonwoven Containing Chitosan After 10 times of laundering in 70° C. hot water with 5 g/L detergent for 45 minutes

| S U | DP nil | MP of CTS wt % | DDA of CTN % | Bactariostasis Value nil | Bactaricidal Value nil | Testing Result Yes/No |
|---|---|---|---|---|---|---|
| 1 | 650 | 0.1 | 87 | >2.1 | >0.5 | No |
| 2 | 650 | 0.5 | 87 | >3.3 | >1.6 | yes |
| 3 | 650 | 1.0 | 87 | >3.7 | >2.4 | yes |
| 4 | 650 | 3.0 | 87 | >4.3 | >2.3 | yes |
| 5 | 650 | 5.0 | 87 | >4.3 | >2.3 | yes |
| 6 | 650 | 7.0 | 87 | >4.3 | >2.3 | yes |
| 7 | 650 | 0.1 | 95 | >2.1 | >0.5 | No |
| 8 | 650 | 0.5 | 95 | >3.3 | >1.6 | yes |
| 9 | 650 | 1.0 | 95 | >3.7 | >2.3 | yes |
| 10 | 650 | 3.0 | 95 | >4.3 | >2.3 | yes |
| 11 | 650 | 5.0 | 95 | >4.3 | >2.3 | yes |
| 12 | 650 | 7.0 | 95 | >4.3 | >2.3 | yes |
| 13 | 1050 | 0.1 | 87 | >2.1 | >0.5 | No |
| 14 | 1050 | 0.5 | 87 | >3.3 | >1.6 | yes |
| 15 | 1050 | 1.0 | 87 | >3.7 | >2.4 | yes |
| 16 | 1050 | 3.0 | 87 | >4.3 | >2.3 | yes |
| 17 | 1050 | 5.0 | 87 | >4.3 | >2.3 | yes |
| 18 | 1050 | 7.0 | 87 | >4.3 | >2.3 | yes |
| 19 | 1050 | 0.1 | 95 | >2.1 | >0.5 | No |
| 20 | 1050 | 0.5 | 95 | >3.3 | >1.6 | yes |
| 21 | 1050 | 1.0 | 95 | >3.7 | >2.4 | yes |
| 22 | 1050 | 3.0 | 95 | >4.3 | >2.3 | yes |

TABLE 8-continued

Anti-bacteria Capability of Cellulose Nonwoven Containing Chitosan After 10 times of laundering in 70° C. hot water with 5 g/L detergent for 45 minutes

| S U | DP nil | MP of CTS wt % | DDA of CTN % | Bactariostasis Value nil | Bactaricidal Value nil | Testing Result Yes/No |
|---|---|---|---|---|---|---|
| 23 | 1050 | 5.0 | 95 | >4.3 | >2.3 | yes |
| 24 | 1050 | 7.0 | 95 | >4.3 | >2.3 | yes |

Remark
S = sample
U = unit
DP = degree of polymerization
MP of CTS = mixing percentage of Chitosan
DDA of CTN = degree of de-acetylation for chitin
The experiment complies with JIS L1902-1998 Quantitative Method having Type (B) bacteria of Klebsiella Pheumoniae (ATCC 4352) as testing bacteria.

TABLE 9

Deodorizing Capability of Cellulose Nonwoven Containing Chitosan After 10 times of laundering in 70° C. hot water with 5 g/L detergent for 45 minutes

| S U | DP nil | MP of CTS wt % | DDA of CTN % | RP of AA % | Testing Result Yes/No |
|---|---|---|---|---|---|
| 1 | 650 | 0.1 | 87 | 17.7 | No |
| 2 | 650 | 0.5 | 87 | 55.5 | yes |
| 3 | 650 | 1.0 | 87 | 68.8 | yes |
| 4 | 650 | 3.0 | 87 | 64.6 | yes |
| 5 | 650 | 5.0 | 87 | 76.6 | yes |
| 6 | 650 | 7.0 | 87 | 71.4 | yes |
| 7 | 650 | 0.1 | 95 | 36.5 | No |
| 8 | 650 | 0.5 | 95 | 63.9 | yes |
| 9 | 650 | 1.0 | 95 | 57.7 | yes |
| 10 | 650 | 3.0 | 95 | 62.5 | yes |
| 11 | 650 | 5.0 | 95 | 69.6 | yes |
| 12 | 650 | 7.0 | 95 | 72.7 | yes |
| 13 | 1050 | 0.1 | 87 | 33.8 | No |
| 14 | 1050 | 0.5 | 87 | 55.6 | yes |
| 15 | 1050 | 1.0 | 87 | 59.9 | yes |
| 16 | 1050 | 3.0 | 87 | 65.7 | yes |
| 17 | 1050 | 5.0 | 87 | 70.8 | yes |
| 18 | 1050 | 7.0 | 87 | 70.6 | yes |
| 19 | 1050 | 0.1 | 95 | 34.8 | No |
| 20 | 1050 | 0.5 | 95 | 53.9 | yes |
| 21 | 1050 | 1.0 | 95 | 62.9 | yes |
| 22 | 1050 | 3.0 | 95 | 67.7 | yes |
| 23 | 1050 | 5.0 | 95 | 68.9 | yes |
| 24 | 1050 | 7.0 | 95 | 69.1 | yes |

Remark
S = sample
U = unit
DP = degree of polymerization
MP of CTS = mixing percentage of Chitosan
DDA of CTN = degree of de-acetylation for chitin
RP of AA = Rate of ammonia absorption From manifestation by experimental data and assess results for anti-mildew and anti-bacteria capability of the cellulose nonwoven fabric with chitosan in the above TABLES 3 through 5, the nonwoven fabric of natural cellulose produced by the method of the present invention really has anti-mildew and anti-bacteria capability if mixing percentage of nano-miniaturized chitosan contain therein is over 0.5 wt %. Besides, all these exemplary embodiments prove that the nonwoven fabric of natural cellulose with nano-miniaturized chitosan produced by the method of the present invention really has anti-mildew and anti-bacteria capability.

From manifestation by experimental data and assess results for deodorizing capability of the cellulose nonwoven fabric with chitosan in the above TABLE 6, the nonwoven fabric of natural cellulose produced by the method of the present invention really has deodorizing capability via illustrative rate of ammonia absorption being over 50% if mixing percentage of nano-miniaturized chitosan contain therein is over 0.5 wt %.

From manifestation by experimental data and assess results for anti-mildew, anti-bacteria and deodorizing capability of the cellulose nonwoven fabric with chitosan under condition of 10 times laundering in 70° C. hot water with 5 g/L detergent for 45 minutes in the above TABLES 7 through 9, the nonwoven fabric of natural cellulose produced by the method of the present invention can still keep about 90% of anti-mildew, anti-bacteria and deodorizing capability as that before laundering for mixing percentage of nano-miniaturized chitosan contain therein is over 0.5 wt %. Therefore, all foregoing exemplary embodiments demonstrate that the nonwoven fabric of natural cellulose with nano-miniaturized chitosan produced by the method of the present invention really has long-term effects in anti-mildew, anti-bacteria and deodorizing capability, which much far exceeds that of the conventional nonwoven fabrics sold in the market as they are only coated or added with anti-bacterias.

In conclusion, the nonwoven fabric of natural cellulose, which is produced by the method of the present invention, indeed has the effects in anti-mildew, anti-bacteria and deodorizing capability. Thereby, it is not only conducive to promote the product application field and decrease the infection probability for human beings, agricultural and fishery livestock as well as by microorganism but also well for reducing the odor creating. Thus, it is really good for adoption in mass production in agricultural and fishery business.

What is claimed is:

1. A meltblown wetlaid method for producing non-woven fabrics with anti-mildew, anti-bacteria and deodorizing capabilities from natural cellulose, comprising the steps of:

(a) selecting wood pulp as raw material, wherein said wood pulp comprises pulp cellulose of staple or filament with cellulose content over 85% and degree of polymerization (DP) between 500 to 1200;

(b) adding N-methylmorpholine N-oxide (NMMO) as dissolving solvent and 1,3-phenylene-bis 2-oxazoline (BOX) as stabilizer into the wood pulp to form mixed cellulose mucilage;

(c) adding and blending modified and nano-miniaturized natural chitosan into the mixed cellulose mucilage to form a cellulose dope via rapidly grinding, blending and dissolving the mixed cellulose mucilage under low temperature of between 60 to 80° C. by horizontal dope blending machine;

(d) dehydrating the cellulose dope via heating to a temperature of between 80 to 120° C. by vacuum thin film evaporator for 5 minutes to decrease the water content of the cellulose dope down to 5 to 13% so that a homogenized mucilaginous dope is formed;

(e) extruding the homogenized mucilaginous dope out of spinnerets by a meltblown method to form a filament bundle; and (f) coagulating the filament bundle with regeneration by ejecting mist aerosol of water; and (g) treating the filament bundle with water rinsing, hydro-entangled needle punching, drying, and winding-up to obtain the nonwoven fabric of continuous filament with anti-mildew, anti-bacteria and deodorizing capabilities.

2. The method of claim 1, wherein for the natural chitosan in above step (c), the primary material source thereof is wasted horny shells of shrimp and crab by chemical treatment with following steps: firstly, by acid and alkali treatment to separate chitin out, then purify it; secondly, by hot alkali treatment for excluding N-acetyl group to form chitosan; and finally, by NaOH treatment with suitably controlled concentration, heating temperature and time to perform deacetylation on the chitosan in range of 50% to 99%.

3. The method of claim 1, wherein for the N-methylmorpholine N-oxide (NMMO) solvent in above step (b), the concentration thereof is 50% to 75%.

4. The method of claim 1, wherein for the nonwoven fabric in above step (a), the texture is continuous filament.

5. The method of claim 1, wherein for the chitosan in above step (c), the molecular weight thereof is in range of 10,000 to 520,000.

6. The method of claim 1, wherein for the chitosan in above step (c), the content percentage thereof in cellulose fiber is 0.1 wt % to 7.0 wt %.

7. The method of claim 2, wherein for the acid and alkali treatment in above step (c), the acid is a strong acid.

8. The method of claim 2, wherein for the acid and alkali treatment in above step (c), the alkali is a strong base.

9. The method of claim 1, wherein for the dope in above step (c), the content percentage of cellulose thereof is 6 wt % to 15 wt %.

10. The method of claim 1, wherein for the dope in above step (c), the viscosity thereof is 300 to 3000 poise.

11. The method of claim 1, wherein for the dope in above step (c), the light transmittance index thereof is 1.470 to 1.495.

12. The method of claim 1, wherein for the dope in above step (c), the melting Index for the dope is 400 to 1000.

13. The method of claim 1, wherein for the nonwoven of natural cellulose in above step (e), the speed of winding-up is 2 to 200 meters per minute.

14. The method of claim 1, wherein for the nonwoven of natural cellulose in above step (e), the fineness of fiber is 1 to 15 μm.

15. The method of claim 1, wherein for the nonwoven of natural cellulose in above step (e), the basis weight thereof is 10 ($g/m^2$) to 300 ($g/m^2$).

16. The method of claim 7, wherein the strong acid is hydrochloric acid (HCl) or sulfuric acid ($H_2SO_4$).

17. The method of claim 8, wherein the strong base is sodium hydroxide (NaOH) or potassium hydroxide (KOH).

* * * * *